United States Patent [19]

Blakeslee

[11] 4,352,470

[45] Oct. 5, 1982

[54] COMBINED PAYOFF AND WINDER FOR STRIP ROLLING MILLS

[75] Inventor: Frederick R. Blakeslee, Wallingford, Conn.

[73] Assignee: Textron, Inc., Providence, R.I.

[21] Appl. No.: 248,572

[22] Filed: Mar. 27, 1981

[51] Int. Cl.[3] ..... B65H 75/28

[52] U.S. Cl. ..... 242/72.1

[58] Field of Search ..... 242/72 R, 72 B, 72.1, 242/68.3, 78.6; 279/214, 2 R; 269/48.1; 82/44

[56] References Cited

U.S. PATENT DOCUMENTS

| | | | |
|---|---|---|---|
| 2,598,398 | 5/1952 | Littell | 242/72.1 |
| 2,755,031 | 7/1956 | Russell | 242/72.1 |
| 3,067,964 | 12/1962 | Smeets | 242/72.1 |
| 3,107,875 | 10/1963 | Gochenouf | 242/72.1 |
| 3,934,836 | 1/1976 | Dunlap | 242/72.1 |

*Primary Examiner*—Edward J. McCarthy
*Attorney, Agent, or Firm*—DeLio and Libert

[57] ABSTRACT

A machine unit which is capable of functioning alternatively as a payoff and as a winder in the handling of coils of metal strip to be fed into a rolling mill (payoff mode) and to be received from the rolling mill (winder mode) comprising an expandible mandrel or block and a tandem piston and cylinder drive for adjusting the diameter of the block in accordance with its selected mode of use.

7 Claims, 17 Drawing Figures

40
41
42
43
44
45
46
47
48
49
50
51
52
53
54
55
56
57
60
63
22
23
27
33
80
81
82
83
84
85
86
87
88

COMBINED PAYOFF AND WINDER FOR STRIP ROLLING MILLS

This invention relates to a machine unit which is capable of functioning alternatively as a payoff and as a winder in the handling of coils of metal strip to be fed into a rolling mill (payoff mode) and to be received from the rolling mill (winder mode).

BACKGROUND

Separately considered, the payoff is a unit which receives a prewound metal coil, having an approximately known inside diameter, and presents it for processing through a rolling mill. The prewound coil is placed loosely on a mandrel (block) which consists of four segments mounted on a stepped pyramid by tee shaped keys to permit expansion of the block diameter. This block is designed to go slightly beyond the actual inside diameter of the coil, to enable the block to hold the coil under tension when the outer courses are being peeled and fed through a rolling mill and pulled onto a winder block. A payoff is designed for relatively light tension since the coil is only being held from rotation by the expansion of the block in the coil.

The winder is a unit downstream from the mill which receives the front edge of a rolled strip from a rolling mill in a gripper on the outside of one of the segments which make up the block. The block is designed to expand to a definite predetermined diameter which will ultimately establish the inside diameter of the coil being formed. Since the strip is being wound around the block while under high tension, care must be taken to prevent the block from squeezing inward. This is done by having a shallower angle on the pyramid which lessens the force that must be exerted by the rotating hydraulic cylinder which operates the block.

Units capable of functioning as payoffs or winders have been long known and used in connection with rolling mills.

SUMMARY OF THE INVENTION

According to the present invention, there is provided a single unit which is intended to fulfill the requirements of both a payoff and a winder. It is able, in the payoff mode, to receive on an expandible mandrel or block a prewound coil having an approximately known inside diameter, and the mandrel or block can expand beyond that diameter, if necessary, to ensure holding the coil under tension. After the coil has been fed through the mill, it is received in the gripper of a payoff-winder block in the winder mode and the block is now expanded to a definite predetermined diameter. A hydraulically actuated tandem piston and cylinder assembly controls the expansion of the block in each of its modes, i.e., as a winder or as a payoff.

OBJECTS OF THE INVENTION

It is an object of the invention to provide a two stage block expansion drive constituted by a hydraulic cylinder having both a full stroke to allow over-expansion of the block as may be required in the payoff mode, and a restricted stroke to ensure the block's stopping at a definite predetermined diameter, as required in the winding mode.

It is yet another object of the invention to provide a new and improved system of manual controls for the supply of hydraulic fluid to the cylinders, in combination with appropriately placed pressure relief valves.

It is a still further object of the invention to provide certain improvements in the form, construction, and arrangement of the several parts by which the above named and other objects may effectively be attained.

A practical embodiment of the invention is shown in the accompanying drawings, wherein.

Figures 4, 7, 8, 9:
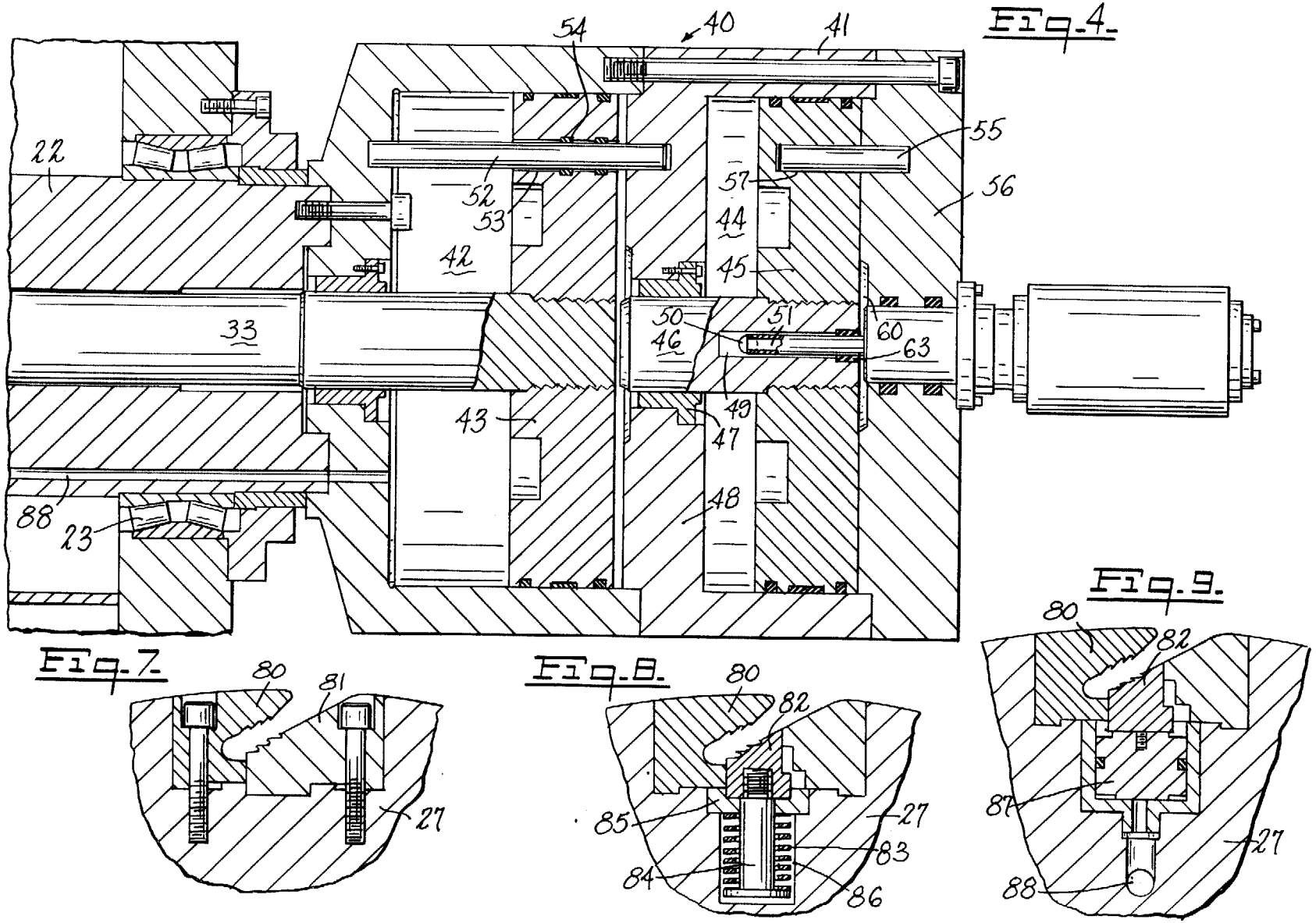
FIG. 4 represents a vertical section on the line IV—IV of FIG. 1.
Figure 5:
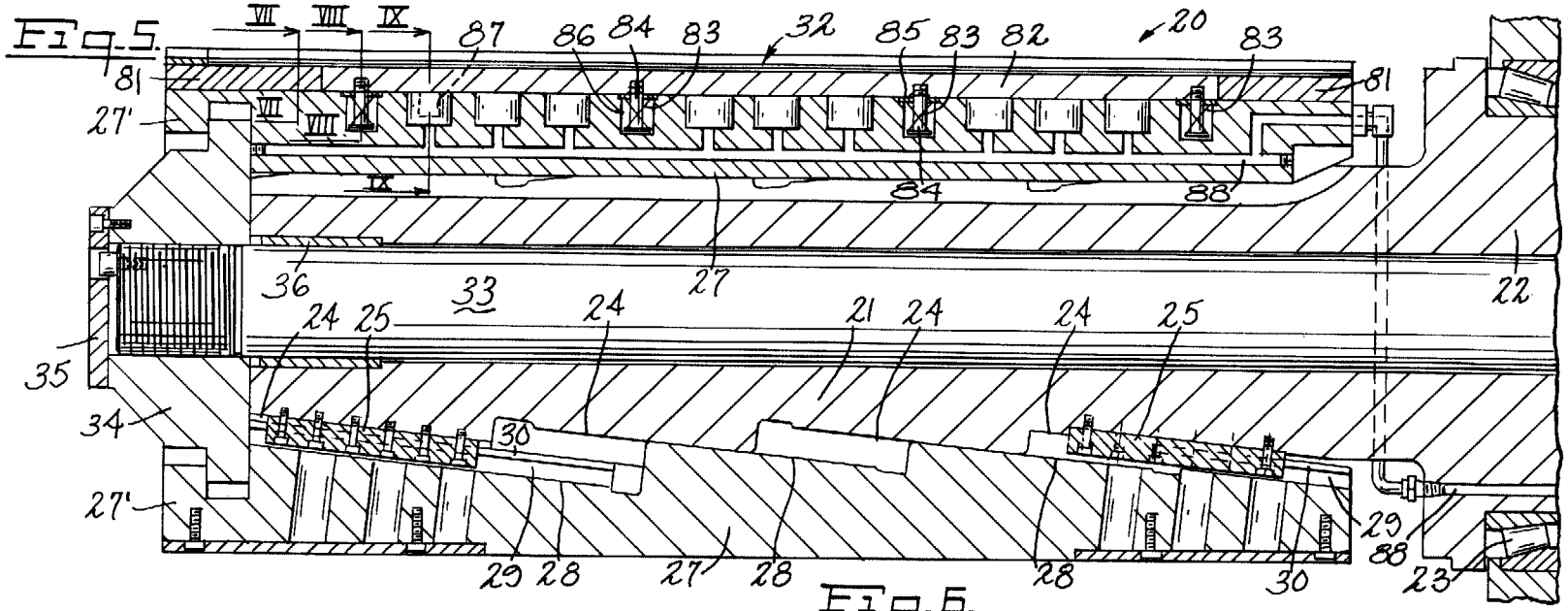
FIG. 5 represents a vertical section through the block on the line V—V of FIG. 1, showing the block elements in expanded position.
Figure 10:
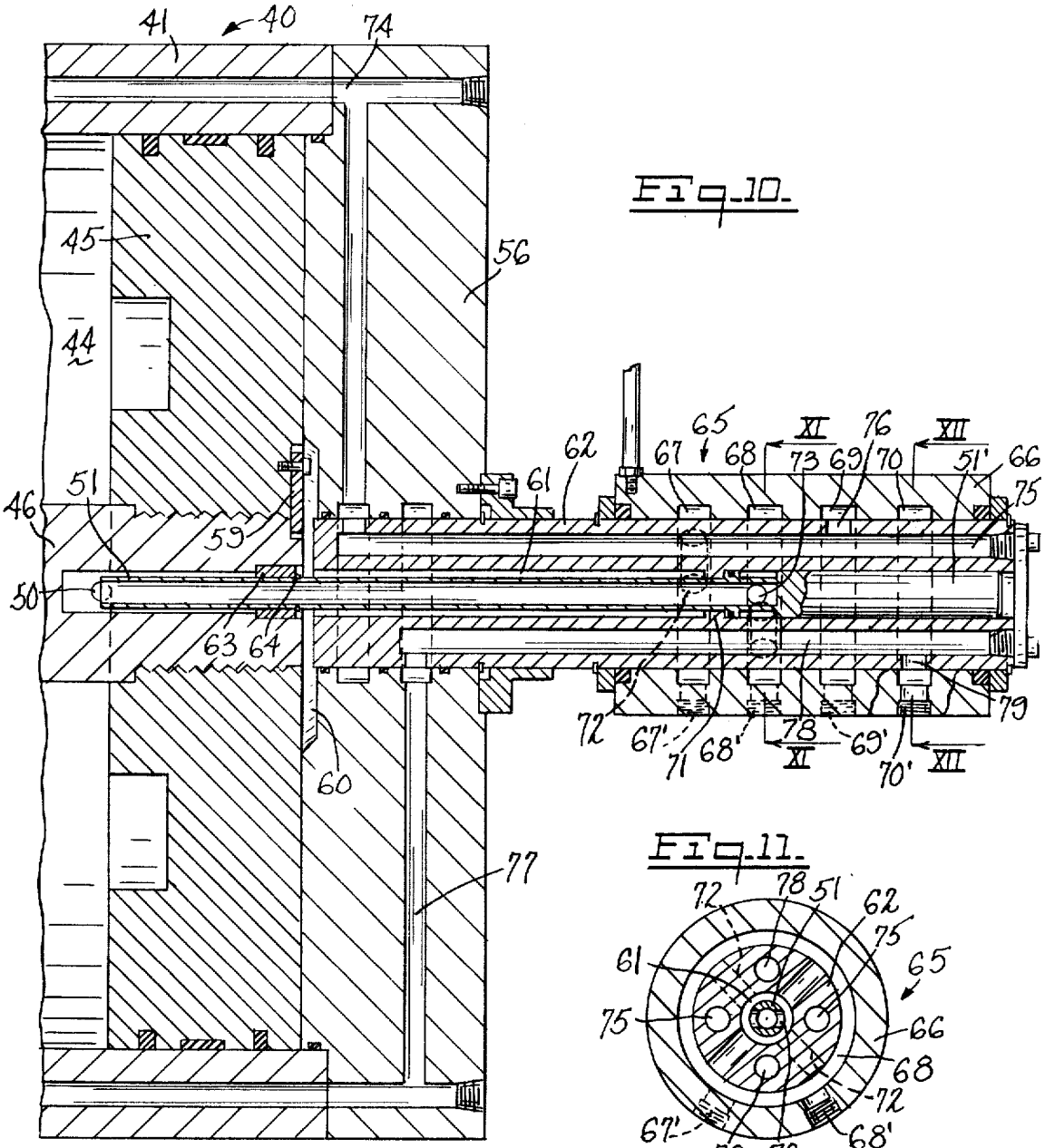
Figure 11:
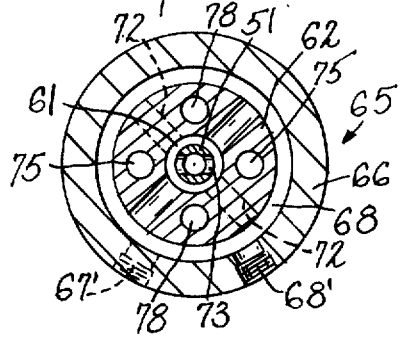
Figure 12:
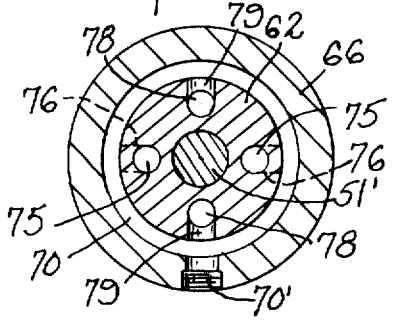
Figure 13:
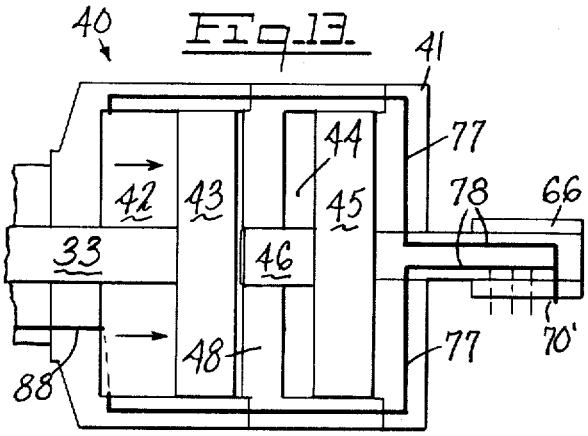
Figure 15:
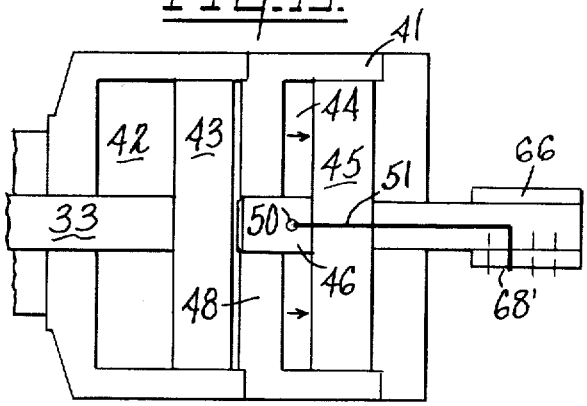
Figure 14:
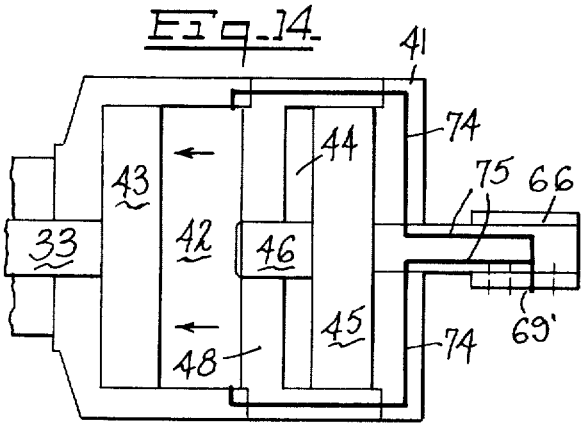
Figure 16:
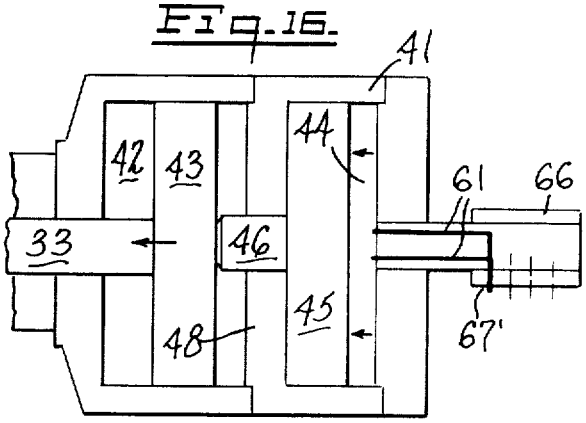
Figure 17:
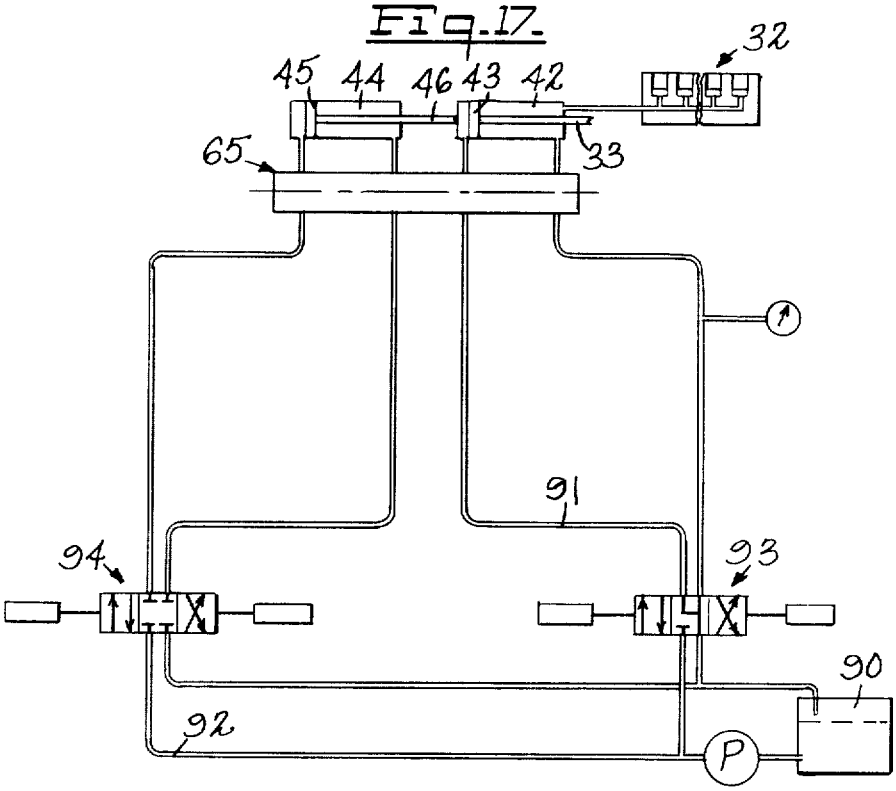

FIGS. 7, 8, and 9 represent detail cross-sectional views on the lines VII—VII, VIII—VIII, and IX'IX of FIG. 5, showing passive and active strip end grippers;

FIG. 10 represents an axial section through the rotary seal assembly, shown at the right of FIG. 4;

FIG. 11 represents a vertical section on the line XI—XI of FIG. 10;

FIG. 12 represents a vertical section on the line XII—XII of FIG. 10;

FIGS. 13 and 14 are diagrammatic representations of the hydraulic fluid flow to the front piston when collapsing and expanding the block;

FIGS. 15 and 16 are diagrammatic representations of the hydraulic fluid flow to the rear piston for determination of block operation in its winder and payoff modes;

FIG. 17 is a hydraulic system diagram showing valve locations and functions.

Referring to the drawings, an expansible and collapsible mandrel or block 20 comprises a pyramid 21, (FIGS. 5 and 6), the hub 22 of which is journaled in bearings 23 supported by a suitable base (not shown). The pyramid outer surface is formed with a plurality of sloping steps 24 (FIGS. 5 and 6, four being shown), the steps nearer each end being provided with elongated "tee bars" 25 which have flanges adapted to guide the cover plates, to be described.

Figure 3:
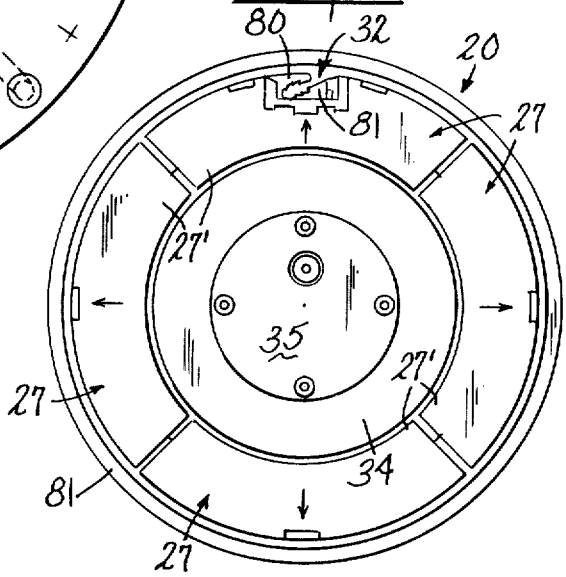
FIG. 3 represents an end elevation of the payoff-winder, viewed from the direction of the arrow III in FIG. 1.

An expansible and compressible surface for the block 20 is constituted by the arcuate outer surfaces of the four segments 27 (FIG. 3), each of which has an inner surface formed with three sloping steps 28 (FIGS. 5 and 6), complementary to the steps 24, the steps nearer each end being provided with elongated tracks 29 in which the flanges of the tee bars 24 are slidably retained by overhanging flanges 30. One segment is provided with a gripper system 32 for a purpose described below.

The pyramid 21 is traversed axially by the push rod 33, a free (front) end of which is threaded and carries the flange nut 34. Each segment 27 terminates in a flange 27' which hooks over the rim of the flange nut 34 to permit relative radial movement while ensuring accurate control of the segments by the push rod in thhe longitudinal direction. Exact adjustment of the push rod in its flange nut is maintained by the provision of the locking cap 35 covering the end of the push rod. Since the relative movement of the push rod in the pyramid is only longitudinal, between the positions shown in FIGS. 5 and 6, a simple bushing 36, within the front end of the pyramid, is all that is needed for anti-friction purposes.

Movement of the push rod 33 to adjust the diameter of the block 20 is effected very precisely by means of a dual mode rotating cylinder 40, shown in FIG. 4. This mechanism comprises a cylindrical housing 41 constituting a front cylindrical chamber 42 containing the front piston 43 and a rear cylindrical chamber 44 containing the rear piston 45. THe front piston 43 is rigidly mounted on the threaded rear end of the push rod 33. The rear piston 45 is rigidly mounted on the threaded end of a separate auxiliary push rod 46 which passes through a bushing 47 in the center of the wall 48 separating the front and rear chambers. The push rod 46 has a bore 49 extending from the outer face of the piston to a vent hole 50, just clear of the front face of the piston, so that hydraulic fluid can be supplied by a tube or quill 51 to the interior of the outer chamber. Each piston is provided with an anti-rotation pin, the pin 52 in the front chamber having its ends fitted in sockets in the chamber head and base and passing through a bore 53 in the piston, hydraulic seals 54 or the like being provided to ensure hydraulic integrity in the chamber. In the rear chamber, a pin 55 is fixed in the cylinder head 56 of the chamber and projects freely into a blind bore 57 in the rear face of the rear piston. Unscrewing of the rear piston from the rod 46 is prevented by the key 59 (FIG. 10).

The front face of the cylinder head 56 is dished, as shown at 60, to receive hydraulic fluid through the passage 61. (FIG. 10) in the rotary seal shaft 62. The tube 51 passes through a bushing 63 in the bore 49 with a fit which may be made leak-proof by the provision of O-rings (not shown), the bushing being held in the push rod bore by a retaining washer 64, or the like.

A manifold 65, constituting a rotating seal, comprises a fixed cylindrical body 66, the bore of which is provided with four annular grooves 67, 68, 69, and 70, each having an inlet 67', 68', 69', 70', respectively, connected to a source of hydraulic fluid under pressure through the system diagrammed in FIG. 17 and hereinafter explained. The shaft of 62 is bored and ported to provide continuous fluid paths to each side of each piston. The central passage 61 (containing the tube 51) terminates at an annular ridge 71 and communicates with a port 72 in register with the groove 67 (FIG. 16). The tube 51 terminates at a solid extension 51', the adjacent end of the tube communicating with a port 73 in register with the groove 68 (FIGS. 11 and 15). A conduit 74 through the wall of the housing 41 to the rear of the front cylinder chamber 42 communicates with the bores 75 in the shaft 62 which have ports 76 in register with the groove 69 (FIGS. 12 and 14) and another conduit 77 through the wall of the housing 41 to the front of the front cylinder chamber 42 communicates with the bores 78 in the shaft 62 which have ports 79 in register with the groove 70 (FIGS. 12 and 13).

As stated above, one segment 27 is provided with a gripper system 32 which is used to engage firmly the leading edge of the metal strip when the payoff-winder is to function in its winding mode. The gripper elements, shown in FIGS. 7, 8, and 9, are conventional, comprising a fixed upper jaw 80, which extends across the width of the segment, in cooperation with fixed lower jaw elements 81 at each end and an elongated movable lower jaw element 82 which, at rest, is retracted to its lowest position by springs 83 between the heads of the spring guides 84 and the washers 85 in the gripper sockets 86. The lower jaw is advanced to strip gripping position by hydraulic pressure applied to pistons 87 (FIG. 9) from the conduit 88, in series with the front side of the chamber 42.

Figure 1:
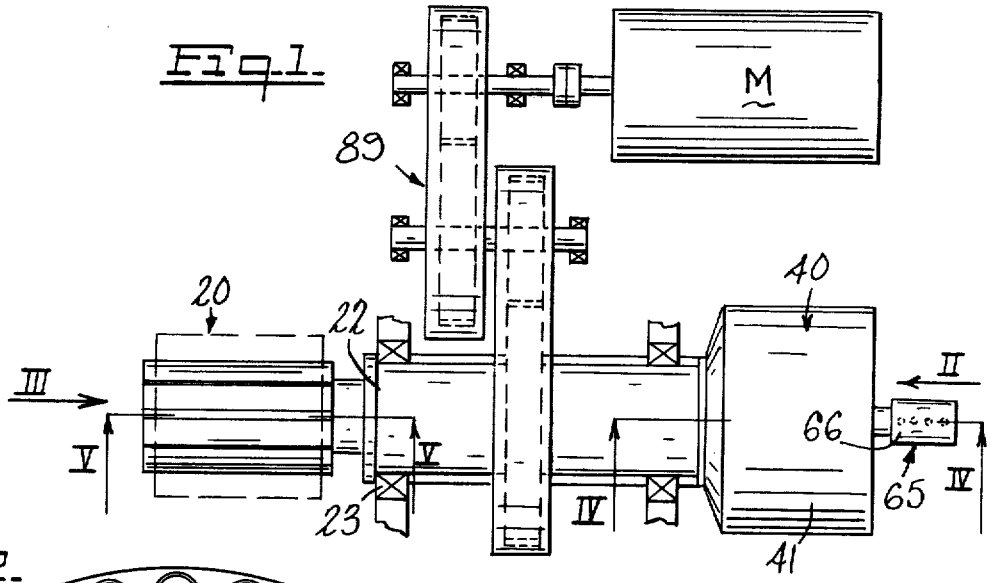
FIG. 1 represents a somewhat diagrammatic elevation showing the payoff-winder block in relation to its drive and diameter control mechanism.
Figure 2:
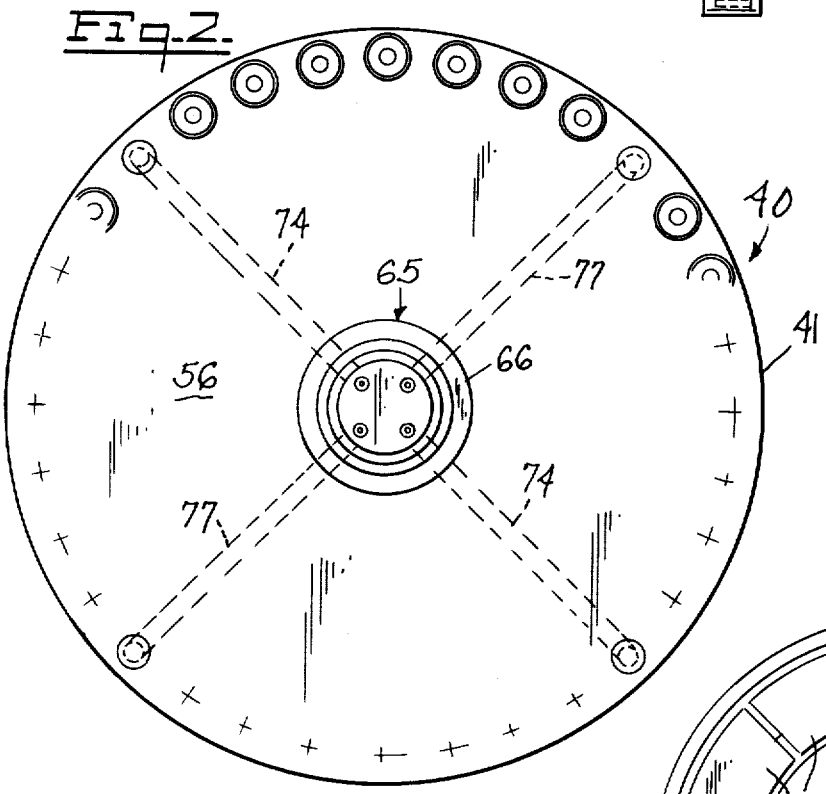
FIG. 2 represents an end elevation of the control mechanism viewed from the direction of the arrow II in FIG. 1.

The drive for the block 20, as shown in FIG. 1, includes a motor M, which may suitably be a 600 HP D.C. motor capable of operation at 300 to 1082 RPM, acting through a gear train 89 to rotate the block 20 and dual mode rotating cylinder 40, connected by the pyramid 22 and supported in roller bearings 23.

Figure 6:
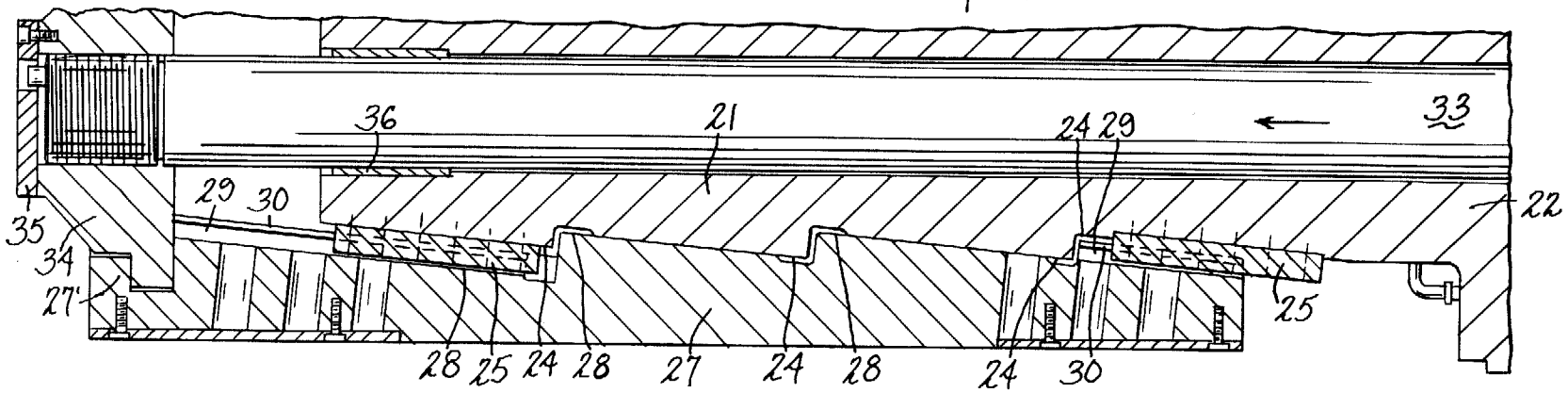
FIG. 6 represents a detail section corresponding to the lower portion of FIG. 5, showing the block elements in contracted position.

The sequence of operation of the payoff-winder, when used on each side of a reversing mill, consists in:

Contracting one of the blocks to the position of FIG. 6 by actuating its pistons in accordance with FIGS. 6 and 14;

Placing on the block a coil of strip to be rolled;

Expanding the block to a position approximating that of FIG. 5 by actuating the piston in the direction indicated in FIG. 13, i.e., sufficiently to hold the coil under tension as it is drawn through the mill by a payoff-winder (in the "winder" mode) on the opposite side;

After the first rolling pass the tail end of the strip is led back through the mill and engaged in the gripper system 32 as the block on the first side is expanded, in its winding mode, to a precise predetermined diameter; in this mode the rear piston is advanced to the position of FIG. 16 so that its push rod 46 limits the block-expanding movement of the front piston, and the re-rolled strip is re-wound into a coil of known dimensions.

In the diagram, FIG. 17, the hydraulic fluid is supplied under pressure from the reservoir 90, by the pump P, to the conduits 91, 92 which actuate, respectively, the front and rear pistons. The front piston acts, as explained above, to collapse and expand the segmented block, while the rear piston moves between positions corresponding to "winder mode", when the strip is held by the gripper assembly and the size of the block is predetermined, and "payoff mode" when the block is expanded as far as necessary to exert a drag on the strip as it is being rolled. Pressurizing the front chamber, when set for winding, also actuates the gripper system, as previously noted. The controls 93,94 are manual solenoid powered switches supplemented by pressure relief valves for relief of each system when reversal is called for.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

What I claim is:

1. A convertible payoff and winder for strip metal comprising a mandrel, means for varying the diameter of the mandrel, and drive mechanism for said diameter varying means, the drive mechanism including means for expanding the mandrel into frictional engagement with the interior of a pre-wound coil of strip metal for operation in the payoff mode, means for arresting the expansion of the mandrel at a predetermined diameter for operation in the winding mode, and separate control means for said expanding means and said arresting means.

2. A convertible payoff and winder according to claim 1 wherein the diameter varying means includes coaxial fixed and movable elements, said elements being engaged along planes lying at acute angles to their mutual axis.

3. A convertible payoff and winder according to claim 2 wherein the drive mechanism comprises a first hydraulic cylinder and piston the piston being operatively connected to the movable element and having a stroke corresponding to the maximum expansion of the mandrel.

4. A convertible payoff and winder according to claim 3 wherein the means for arresting the expansion of the mandrel includes a second hydraulic cylinder and piston, the piston being movable into and out of a position where it arrests the movement of the first piston at the end of a stroke corresponding to the expansion of the mandrel to a predetermined diameter.

5. A convertible payoff and winder according to claim 4 wherein the pistons are in axial alignment.

6. A convertible payoff and winder according to claim 4 wherein the second piston is free floating in the second cylinder.

7. A convertible payoff and winder according to claim 3 which includes a gripper assembly on the surface of the mandrel and hydraulic means for actuating the gripper, said gripper actuating means being operatively associated with the first hydraulic cylinder.

* * * * *